US006963718B2

(12) United States Patent
Sekiguchi

(10) Patent No.: US 6,963,718 B2
(45) Date of Patent: Nov. 8, 2005

(54) HEATING APPARATUS AND IMAGE FORMING APPARATUS

(75) Inventor: Hajime Sekiguchi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/270,142

(22) Filed: Oct. 15, 2002

(65) Prior Publication Data

US 2003/0077093 A1 Apr. 24, 2003

(30) Foreign Application Priority Data

Oct. 12, 2001 (JP) ..... 2001-315072

(51) Int. Cl.[7] ..... G03G 15/20
(52) U.S. Cl. ..... 399/328; 399/69
(58) Field of Search ..... 399/328, 320; 219/216

(56) References Cited

U.S. PATENT DOCUMENTS

| | | | | |
|---|---|---|---|---|
| 5,083,168 | A | 1/1992 | Kusaka et al. | 355/285 |
| 5,148,226 | A | 9/1992 | Setoriyama et al. | 355/290 |
| 5,210,579 | A | 5/1993 | Setoriyama et al. | 355/285 |
| 5,525,775 | A | 6/1996 | Setoriyama et al. | 219/216 |
| 5,767,484 | A | 6/1998 | Hirabayashi et al. | 219/216 |
| 6,453,144 | B1 * | 9/2002 | Sato | 399/328 |
| 6,492,630 | B2 * | 12/2002 | Nagahira | 219/619 |

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-166966 | 6/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 5-9027 | 2/1993 |
| JP | 9-171889 | 6/1997 |
| JP | 10-74009 | 3/1998 |

* cited by examiner

*Primary Examiner*—Quana Grainger
(74) *Attorney, Agent, or Firm*—Fitzpatrick, Cella, Harper & Scinto

(57) ABSTRACT

A heating apparatus includes a core; magnetic flux generating means having an excitation coil provided outside the core; an induction heat generating element for electromagnetic induction heat generation using the magnetic flux generated by the magnetic flux generating means, a heating portion for receiving a recording material and for heating the recording material by the heat generated by the induction heat generating element, the heating portion being elongated in a longitudinal direction crossing with a direction in which the recording material is fed to the heating portion; magnetic flux adjusting means for changing a distribution, in the longitudinal direction, of densities of the magnetic flux generated by the magnetic flux generating means in the heating portion; the magnetic flux adjusting means including a magnetic flux shield member, and moving means for moving the magnetic flux shield member to a position for adjusting the magnetic flux generated by the magnetic flux generating means, the magnetic flux shield member being effective to block the magnetic flux at a position between the core and the excitation coil.

13 Claims, 13 Drawing Sheets

HEATING APPARATUS AND IMAGE FORMING APPARATUS

FIELD OF THE INVENTION AND RELATED ART

The present invention relates to a heating apparatus of an electromagnetic (magnetic) induction heating type and an image forming apparatus comprising the same as an image heating device for image fixing or the like.

An image heat-fixing device in an image forming apparatus such as an electrophotographic copying machine, printer or facsimile machine will be taken as an example.

In the image forming apparatus, a toner (visualization material) of heat-fusing property resin material or the like Is formed directly or indirectly (image transfer) on a recording material by image forming process means of an electrophotographic, electrostatic recording, magnetic flux recording type or the like in an image forming station of the image forming apparatus. The toner image thus formed is not yet fixed. It is fixed into a permanent fixed image by heat fixing process on the surface of the recording material.

As for such an image heat-fixing device, there are known a heating roller type, film heating type, electromagnetic induction heating type or the like.

a. Heating roller type

This comprises a fixing roller (heat roller) containing a heat source such as a halogen lamp and maintained at a predetermined fixing temperature and a pressing roller forming a nip with the fixing roller. The recording material carrying the unfixed toner image is passed through the nip ((fixing nip), so that toner image is fixed on the recording material by heat.

However, the fixing roller has a large thermal capacity, and the electric power required for heating through roller is large, with the result that waiting time (the time from the main switch actuation to the printable state reached) is long. The thermal capacity of the fixing roller requires a great electric power to raise the temperature of the fixing nip.

As a countermeasurement, the thickness of the fixing roller is reduced so that thermal capacity or the fixing roller is reduced. However, doing so results in an insufficient mechanical strength. In addition, it involves a problem of temperature rise in a non-sheet-passage-part, similarly to the film fixing type which will be described hereinafter.

b. Film heating type

In this type of the device, a film is provided between a heating element and a recording material so that one side of film is in sliding contact with a heating element, and the other side is in contact with the surface. The heat is applied from the heating element to the recording material through the film, by which the toner image is heated and fixed on the surface of the recording material, as disclosed in Japanese Laid-open Patent Application Sho 68-313182, Japanese Laid-open Patent Application Hei 2-157878, Japanese Laid-open Patent Application Hei 4-44075 to 4-44083, 4-204980 to 4-204984).

The heating element may be a low thermal capacity ceramic heater, and the film may be a heat resistive and low thermal capacity film, and therefore, the electric power can be significantly saved as compared with the heating roller type apparatus, and the waiting time reduction in addition accomplished (quick start property). In addition, the temperature rise in the apparatus is suppressed.

c. Electromagnetic induction heating type

This type uses an electromagnetic induction heat generation member, and a magnetic field is formed in the electromagnetic induction heat generation member by magnetic field generating means, by which eddy currents are generated in the electromagnetic induction heat generation member, and joule heat generation occurs. The heat thus produced is applied to the recording material (material to be heated), so that unfixed toner image is heat-fixed on the recording material.

Japanese Patent Application Publication Hei 5-9027 discloses an apparatus of a heating roller type using electromagnetic induction heating, in which the heat generation position is close to the nip, so that fixing process has a high efficiency then the apparatus of the heating roller type using the halogen lamp as a heat source.

However, since the thermal capacity of the fixing roller is large, the electric power consumption to raise the temperature of the fixing nip is still large. Reduction of the thermal capacity of the fixing roller is a solution of the problem. For example, the thickness of the fixing roller is reduced.

Japanese Laid-open Patent Application Hei 4-166966 discloses a fixing device of an electromagnetic induction heating type using a film-like fixing roller (film) as a fixing roller having a low thermal capacity.

However, in the film-like fixing roller, the heat flow is not good in the longitudinal direction of the fixing nip, with the result that when a small size recording material is passed through the nip, a problem of excessive temperature rise arises, the problem decreases the lifetime or the film and/or the pressing roller. The problem of the temperature rise at the non-sheet-passage-part also arises in the apparatus of the film heating type described in b.

Japanese Laid-open Patent Application Hei 9-171589 and Japanese Laid-open Patent Application Hei 10-74009 disclose a heating apparatus having a magnetic flux adjusting means by which a magnetic flux density distribution in the induction heat generating element provided by the generating means, in the longitudinal direction of the fixing roller (film). It is one of the solutions of preventing the temperature rise of the non-sheet-passage-part.

The systems disclosed in Japanese Laid-open Patent Application Hei 9-171889 and Japanese Laid-open Patent Application Hei 10-74009 are very effective to prevent the heat generation in the non-sheet-passage-part, thus preventing the temperature rise of the non-sheet-passage-part. However, a shield plate for shielding the magnetic flux toward the fixing roller or the film from the coil and a mechanism for moving the shield plate are bulky.

Another method for solving the problem of the temperature rise in the non-sheet-passage-part, the fixing speed is decreased when a small size recording material is passed. This method result in decreased throughput. By slowing down the fixing speed, the heat propagation toward the lateral ends (non-sheet-passage-part) is promoted. However, the throughput of the image forming apparatus decreases.

SUMMARY OF THE INVENTION

Accordingly, it is a principal object of the present invention to provide a heating apparatus of an electromagnetic induction heating type and an image forming apparatus using the same wherein a temperature rise in a non-sheet-passage-part is prevented.

It is another object of the present invention to provide a heating apparatus and an image forming apparatus using the same wherein a non-sheet-passage-part temperature rise is prevention d, and a magnetic flux shield mechanism and a driving mechanism therefor can be downsized.

According to an aspect of the present invention, there is provided a A heating apparatus comprising a core; magnetic flux generating means having an excitation coil provided outside said core; an induction heat generating element for electromagnetic induction heat generation using the magnetic flux generated by said magnetic flux generating means, a heating portion for receiving a recording material and for heating the recording material by the heat generated by said induction heat generating element, said heating portion being elongated in a longitudinal direction crossing with a direction in which the recording material is fed to said heating portion; magnetic flux adjusting means for changing a distribution, in the longitudinal direction, of densities of the magnetic flux generated by said magnetic flux generating means in said heating portion; said magnetic flux adjusting means including a magnetic flux shield member, and moving means for moving said magnetic flux shield member to a position for adjusting the magnetic flux generated by said magnetic flux generating means, said magnetic flux shield member being effective to block the magnetic flux at a position between said core and said excitation coil.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

(1) Example or Image Forming Apparatus

Figure 1:
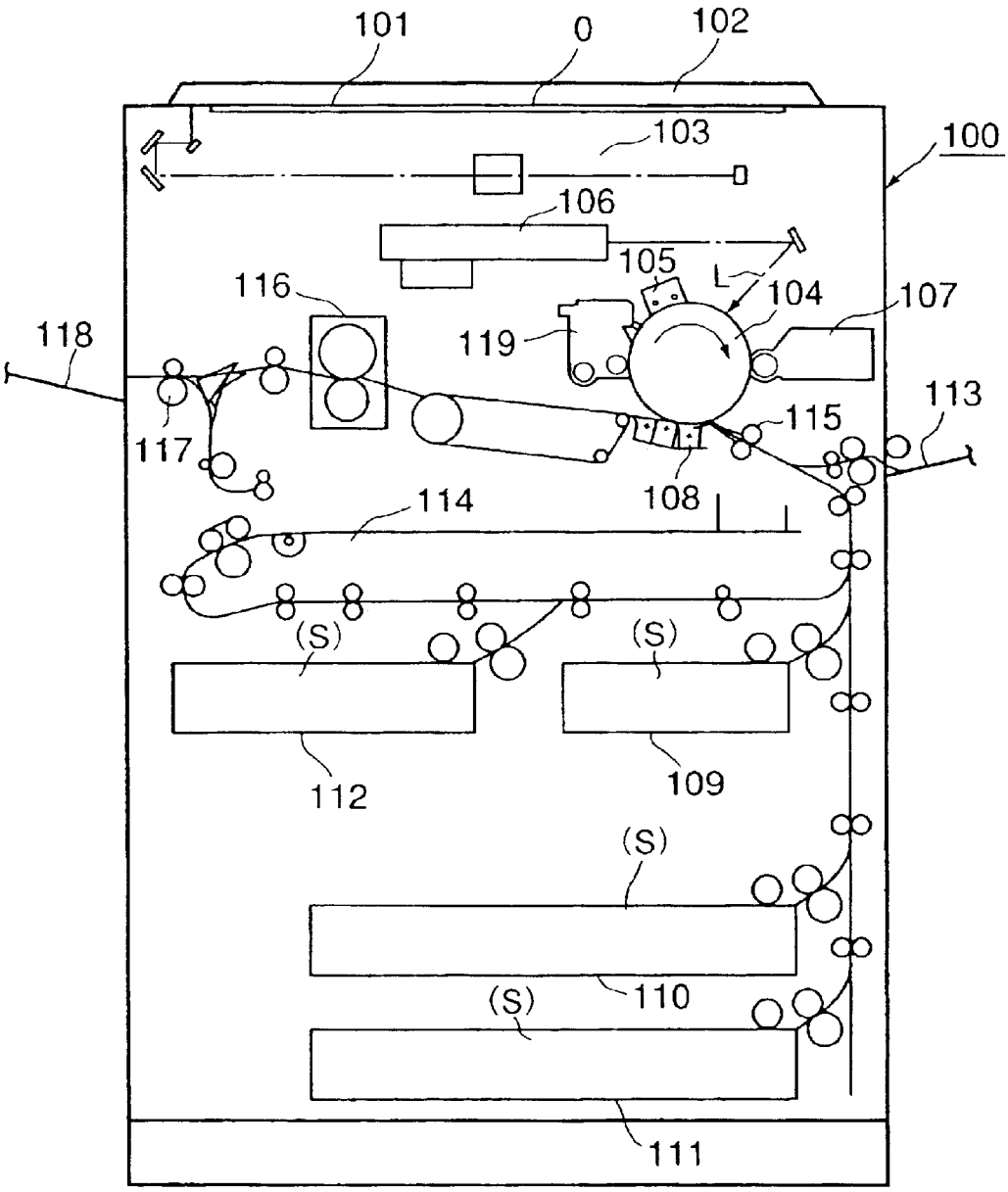
FIG. 1 in addition a schematic general arrangement of an image forming apparatus according to a first embodiment of the present invention.

FIG. 1 is a schematic general arrangement of an image forming apparatus 100 according to a first embodiment of the present invention. In this embodiment, the image forming apparatus 100 is a laser copying machines using an image transfer type electrophotographic process.

Designated by 101 is an original supporting platen glass, on which an original O is placed face down at a predetermined position, and is covered by an original cover 102. When a copy start key is depressed, an image photoelectric reading apparatus including a movement optical system (reader) 103 is operated, so that image information or the original O on the original supporting platen glass 101 is photo-electrically read. On the original supporting platen glass 101, an original automatic feeding apparatus (ADF, RDR) may be provided such that originals are automatically fed onto the original supporting platen glass 101.

Designated by 104 is an electrophotographic photosensitive member in the form of a rotatable drum, and is rotated in the clockwise direction indicated by an arrow at a predetermined peripheral speed. The peripheral surface of the photosensitive drum 104, during its rotation, is electrically charged to a uniform potential of a predetermined polarity. The charged surface is exposed to image exposure light L from an image writing apparatus 106, by which the potential of the charged surface attenuates at the exposed portions, and an electrostatic latent image is formed corresponding to the exposure pattern on the surface of the photosensitive drum 104. In this embodiment, the image writing apparatus 100 is a laser scanner which emits a laser beam L modulated in accordance with an electric time-series digital signal indicative of the image information read by said photoelectric reading apparatus 103.

Subsequently, the electrostatic latent image is developed into a toner image by a developing device 107, and the toner image is electrostatically transferred from the surface of the photosensitive drum 104 onto a recording material S fed from a sheet feeding mechanism portion at predetermined timing to a transfer portion where a transfer charging device 108 is opposed to the photosensitive drum 104.

The sheet feeding mechanism portion, in this embodiment, has first, second, third and fourth cassettes 109-112, MP tray (multi-pass tray) 113, and a reverse refeeding portion 114, from which the recording material S is selectively fed to the transfer portion. Designated by 115 is a registration roller for adjusting the timing of the supply of the recording material to the transfer portion.

The recording material now having the toner image received from the surface of the photosensitive drum 104 at the transfer portion, is separated from the surface of the photosensitive drum 104, and is fed to a fixing device 116, where the toner image is fixed. Then, the recording material is discharged onto a sheet discharge tray 118 outside the apparatus by sheet discharging rollers 117.

On the other hand, the surface of the photosensitive drum 104 after the separation of the recording material, is cleaned by a cleaning device 119 so that deposited contamination such as residual toner or the like is removed, and the photosensitive drum 104 is prepared for the next image forming operation.

In the case of a duplex copy mode (both side copy or printing mode), the recording material already having the image on the first side and discharged from the fixing device 116, is introduced to the reverse refeeding portion 114 and is refed to the transfer portion, where the second toner image is transferred onto the second side of the recording material. The recording material is again fed to the fixing device 116 and is discharged onto the sheet discharge tray 118 by the sheet discharging rollers 117 as a duplex copy.

The copying machine in this embodiment is a combined function machine having a printer function and a facsimile machine function. However, these functions are omitted for simplicity of explanation of the present invention.

(2) Fixing Device 116

Figure 2:
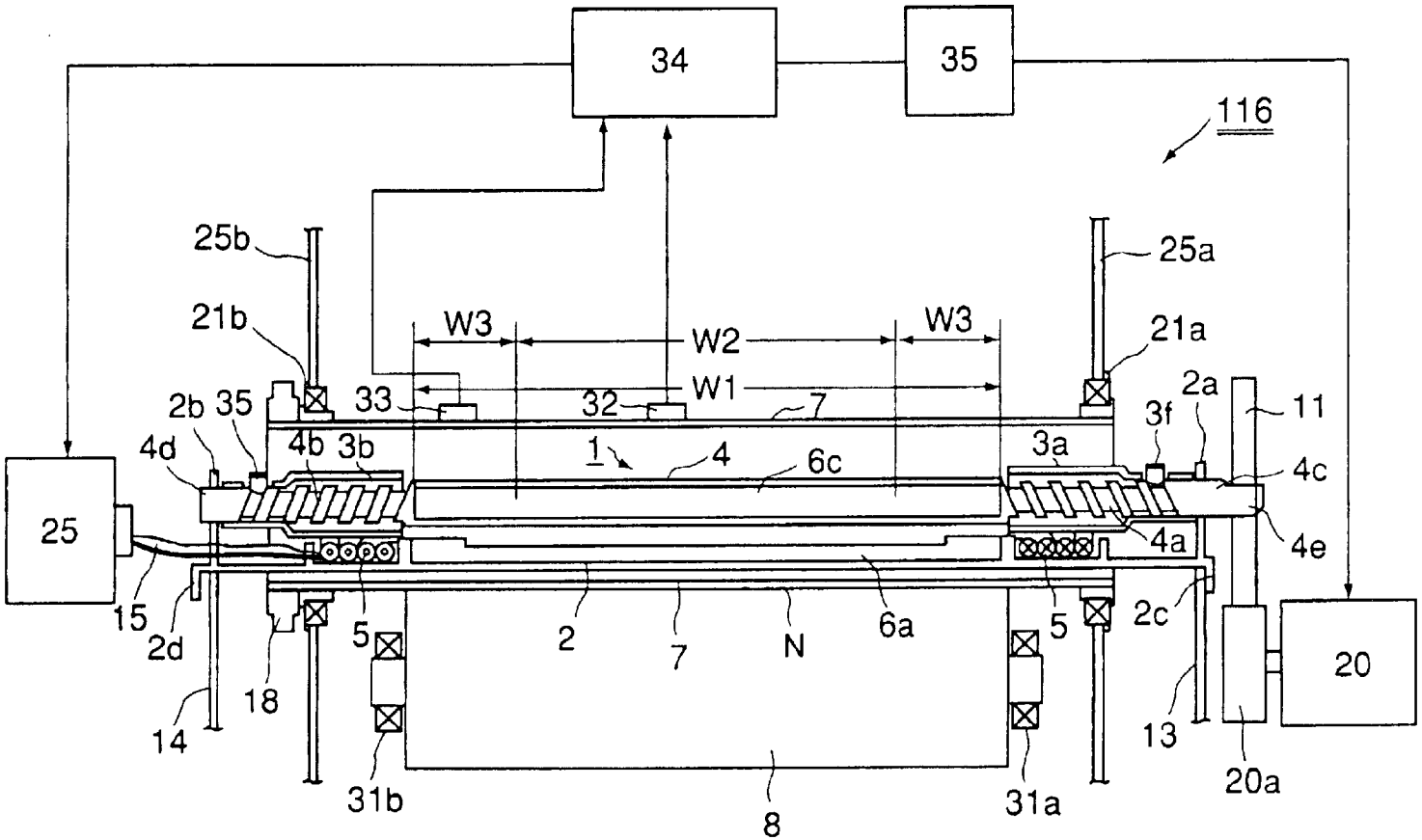
FIG. 2 is a schematic longitudinal sectional view of a fixing device (electromagnetic induction heating type heating apparatus), wherein a magnetic flux shield member is at a first position.
Figure 3:
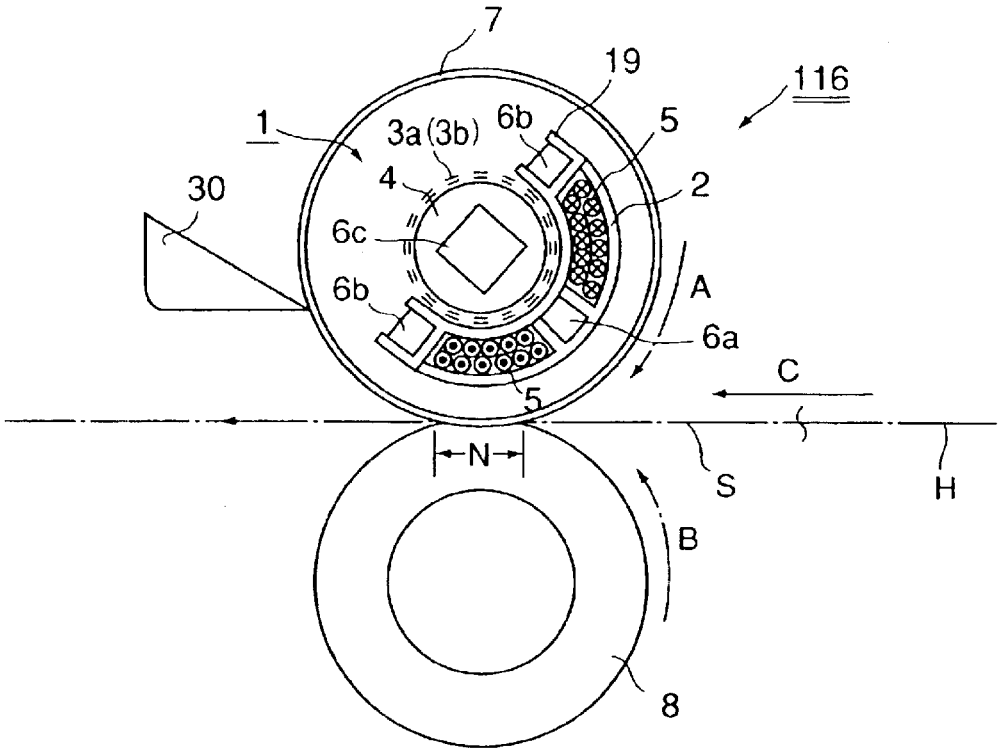
FIG. 3 is a schematic cross-sectional view thereof.

FIG. 2 is a longitudinal section schematic view of a fixing device 116, and FIG. 3 is a cross-section thereof. The fixing device 116 is of an electromagnetic induction heating type according to an embodiment of the present invention.

Designated by 7 is a cylindrical fixing roller functioning as an induction heat generating element which generates heat using electromagnetic induction and is rotatably supported between side plates 25*a* and 25*b* by bearings 21*a* and 21*b*. The fixing roller 7 is made of metal such as iron, nickel, cobalt or the like. The metal having ferromagnetic property (having a high magnetic permeability) is desirable since then the magnetic flux generated from the magnetic flux can be confined efficiently in the metal. That is, the magnetic flux density can be made high. By doing so, the eddy currents can be generated efficiently in the surface of the metal. The thickness of the fixing roller 7 is approx 0.3–2 mm, and therefore, the thermal capacity is small. The outer surface of the fixing roller 7 is coated with an unshown toner parting layer. Generally, the coating is made of PTFE (10–50 $\mu$m) or PFA (10–50 $\mu$m). Inside of the toner parting layer, there is provided a rubber layer.

Designated by 1 is a heating assembly of a magnetic flux adjustment type disposed in the fixing roller 7, and comprises a magnetic flux generating means 5 and 6 (*a–c*) and magnetic flux adjusting means 3 (*a* and *b*) and 4 or the like. The structure of the heating assembly 1 will be described in detail in section (3).

Designated by 8 is an elastic pressing roller disposed in parallel with the fixing roller below the fixing roller 7, and is rotatably supported between the bearings 31*a* and 31*b*. It is press-contacted to the lower surface of the fixing roller 7 with a predetermined pressure against the elasticity of the fixing roller 7 by an unshown urging means, thus providing a fixing nip N (heating portion) having a predetermined width. The pressing roller 8 comprises a steel core, a silicone rubber layer thereon and a toner parting layer similarly to the fixing roller 7.

The fixing roller 7 has at one end a fixing roller gear 18 to which a rotating force is transmitted from an unshown driving system, and is rotated in the direction clockwise direction indicated by an arrow An in FIG. 3 at a predetermined peripheral speed. The pressing roller 8 is rotated by the rotation of the fixing roller 7 in the counterclockwise direction indicated by an arrow B.

The excitation coil 5 of the heating assembly 1 in the fixing roller 7 is supplied with electric power (high frequency current) from an electric power control apparatus (excitation circuit) 25 through a coil supply line 15, by which magnetic flux (alternating magnetic field) is generated from the heating assembly 1, and the fixing roller 7 (induction heat generating element) generates heat by inner (joule heat by eddy current loss). The temperature of the fixing roller 7 is detected by a first temperature detecting means (thermister or the like) 32, and the output thereof is supplied to the control circuit 34. The control circuit 34 controls the electric power supply to the excitation coil 5 of the heating assembly 1 from the electric power control apparatus 25 such that detected temperature of the fixing roller 7 supplied from a second temperature detecting means 32 is maintained at a predetermined fixing temperature, by which the temperature of he fixing roller is controlled.

When the fixing roller 7 and the pressing roller 8 are rotated, and the temperature of the fixing roller 7 is raised to the fixing temperature, the recording material S carrying the unfixed toner image transferred thereto is introduced into the fixing nip N of the fixing device 116 in the direction indicated by arrow C along the sheet feeding path H, as shown in FIG. 3. During the passing of the recording material S through the nip N, the unfixed toner image is fixed on the recording material S into a permanent fixed image by the heat and the nip pressure of the fixing roller 7. Designated by 30 is a separation claw, and is introduced to the fixing nip N to prevent the recording material from winding around the fixing roller 7 after the fixing nip N and to separate it from the fixing roller 7.

The recording material S is fed into the fixing device 116 on the basis of a center reference, that is, the center of the width or the sheet is aligned with the center of the width of the heating device. In FIG. 2, W1 is a maximum width of recording materials S which are usable with the fixing device 116, W2 is a width of a small size recording material, and W3 and W3 are widths of non-sheet-passage-parts which result in the fixing nip N when the small size sheet of paper (sheet) having the width W2 is passed through the nip, and are the differences between the maximum size sheet W1 and the small size sheet.

In the fixing device 116 of this embodiment, the width W1 of the maximum size sheet is the width or A4 size sheet (297 mm), and the width W2 of the small size sheet is the width of A4R (210 mm). In this embodiment, the maximum size sheet width W1 is the normal sheet width.

(3) Heating Assembly 1

The heating assembly 1 comprises a holder 2, magnetic flux generating means which includes an excitation coil 5 and a magnetic member core 6(*a, b, c*), a magnetic flux shield member 3(*a, b*) constituting magnetic flux adjusting means and a lead screw member 4 for moving them (moving means).

The holder 2 has a trough-like shape having a substantially semi-circular cross-section, and the inner surface thereof supports a first magnetic member core 6*a* (first core 6*a*) substantially at the central portion thereof along the length thereof. The length of the first core 6*a* is substantially the same as the normal sheet size width W1 and is positioned corresponding to the normal size sheet fed to the heating apparatus.

The excitation coil 5 (coil 5) is supported by the inner surface of the holder 2 concentrically with the first core 6*a*. The coil 5 has coil 5 is substantially elliptical in the longitudinal direction of the fixing roller 7 and follows in shape the inner surface of a cylindrical member such as the fixing roller 7. The coil 5 has a feature that it extends along the inner surface of the fixing roller 7 at the U-shaped turning portion. Because of this feature, a lead screw member 4 which will be described hereinafter can be disposed adjacent the coil 5. The coil 5 is disposed extending along the inner surface of the holder 2.

Designated by 19 is a holder plug having a trough shape having a substantially semicircular cross-section and is fitted in the opening of the holder 2 in which the first core 6*a* and the coil 5 are supported, so that first core 6*a* and coil 5 are confined between the holder 2 ant holder plug 19.

At the lateral end portions of the holder plug 19, second magnetic cores 6*b*, 6*b* (second core 6*b*) are supported, respectively. The length of the second core 6*b* is substantially the same as the normal sheet width W1 and is positioned corresponding to the normal size sheet.

A lead screw member 4 us extended in parallel with the holder plug 19, and is provided in the trough at the central portion of the holder plug such that axis is substantially aligned with the trough. Shaft end portions 4*c*, 4*d* are rotatably supported by bearings 2*a*, 2*b* provided at the opposite end portions of the holder 2. The bearings 2*a* 2*b* may be separate members of durable material.

The shaft portions of the lead screw member 4 at one and the other end portions are screw portions 4*a*, 4*b* which are twisted in the opposite directions. In the central portion between the screw portions 4*a*, 4*b* of the lead screw member 4, there is provided a third magnetic member core 6*c* (third core 6*c*). The length of the first core 6*a* is substantially the same as the normal sheet size width W1 and is positioned corresponding to the normal size sheet fed to the heating apparatus. The third core 6*c* is bonded at a core set portion of the lead screw member 4 and is unified with the lead screw member 4 by snap engagement. They may be unified by resin material molding. The unification method of the lead screw member and the core is not limited in the present invention.

Thus the magnetic member core 6 constituting the magnetic flux generating means is divided into the first core 6, two second core 6 an and 6*b*, and a third core 6*c* which are parallel with each other. Using the divided cores 6*a*, 6*b* and 6*c*, magnetic flux passage (magnetic circuit) is formed, such that magnetic flux shielding members 3*a*, 3*b* are movable between the cores.

Figure 5:
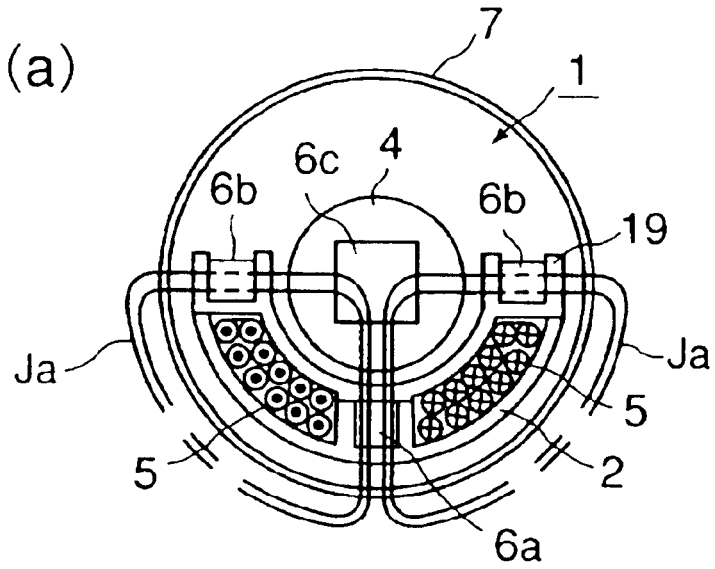
FIG. 5 is a schematic diagram of a magnetic circuit at positions where the magnetic flux shield member is provided and where the magnetic flux shield member is not provided.
Figure 5:
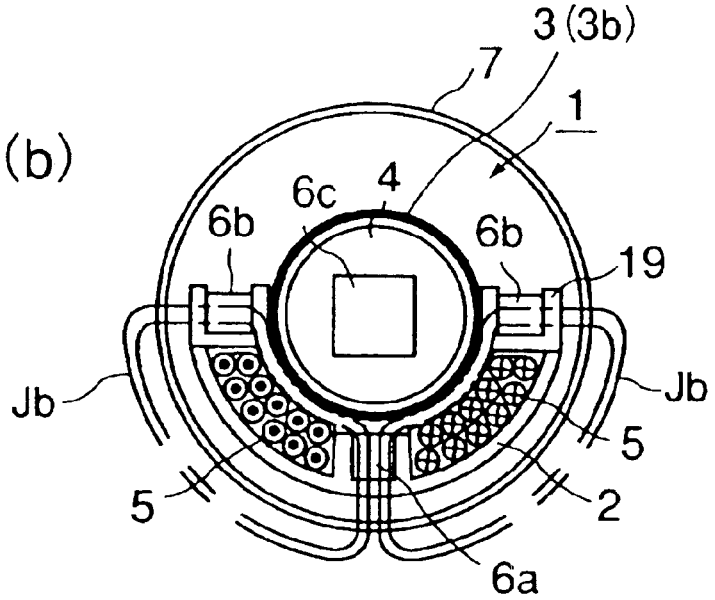

In this embodiment, in the cross-section shown in FIG. 3, a perpendicular portion is constituted by the first core 6*a* at the winding central portion of the coil 5, a horizontal portion is constituted by the two the second cores 6*b*, 6*b*, and a substantially T-shaped central portion is constituted by the second core 6*c*, so that first, second and third cores 6*a*, 6*b*, 6*c* constitutes a core 6 having a T-shaped cross-section. When the magnetic flux blocking members 3*a* and 3*b* do not intervene, a magnetic circuit Ja is formed as shown in FIG. 5. Here, the lines of magnetic force Ja correspond to a magnetic when the electric power is supplied to the coil 5 from the electric power control apparatus 25. The magnetic force lines Ja extend through the first core 6*a* (perpendicular portion), the fixing roller 7, second core 6*b* (horizontal portion) and the third core 6*c* (central portion). Actually, the magnetic force lines extend through the inside the fixing roller 7 having a high magnetic permeability, but for the purpose of better illustration, they are extended as shown in the Figure.

The third core 6*c* in this embodiment has a square cross-sectional configuration to minimize the influence of rotation of the lead screw member 4. Even when the rotation of the lead screw member 4 stops such that cross-section is more or less inclined, the distribution of the fixing roller surface temperature (in the longitudinal direction) is not influenced, although the total heat generation efficiency changes. In this embodiment, the square cross-sectional configuration is employed. In other words, the shapes are symmetrical. If the use is made with a circular column shape core, the influence of the rotation of the lead screw member 4 can be eliminated.

In this embodiment, as shown in FIG. 2, the ends of the first core 6*a* are larger than the central portion so as to supplement the heat released from the ends of the fixing roller 7.

Figure 4:
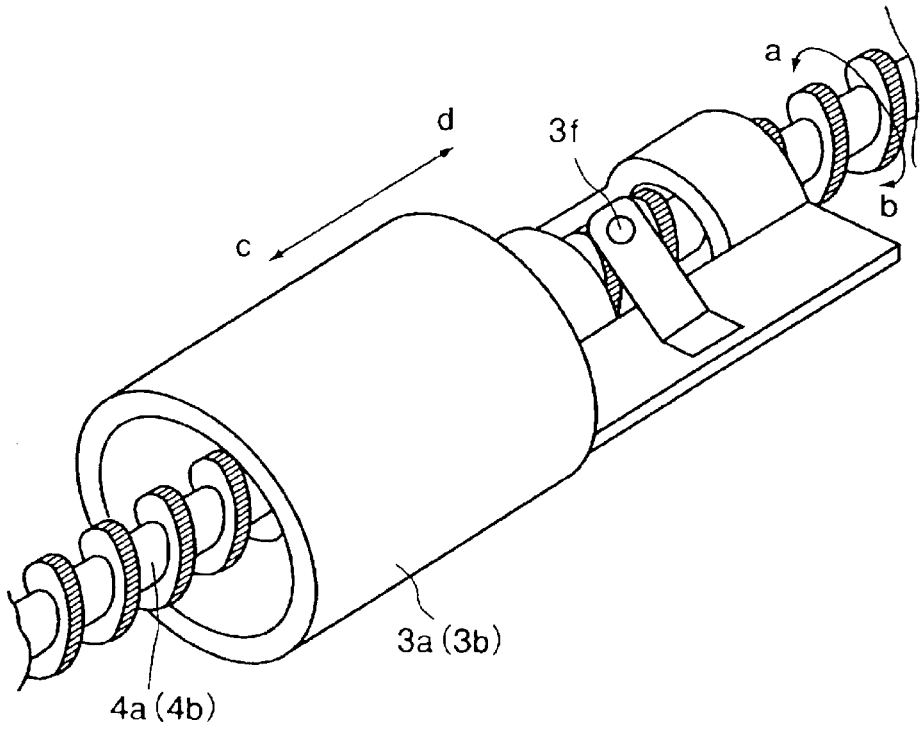
FIG. 4 in addition a schematic perspective view of one side or the magnetic flux shield member.

The screw portion 4*a* and 4*b* at one and the other ends of the lead screw member 4 are fitted around by cylindrical magnetic flux shielding members 3*a*, 3*b*, and the boss portions 3*f* are engaged with the screw portions 4*a*, 4*b*. Rotation of the magnetic flux shield members 3*a* and 3*b* is prevented from unshown rotation preventing member. FIG. 4 is a schematic perspective view of a magnetic flux shield member 3 (*a* and *b*) portion. When the lead screw member 4 is rotated in the forward rotational direction, the two magnetic flux shield members 3*a* and 3*b* are advanced in the thrust direction along the lead screw member 4 toward the third core 6*c*; and when the lead screw member 4 is rotated in the backward rotational direction, the two magnetic flux shield members 3*a* and 3*b* are retracted in the thrust direction along the lead screw member 4 away from the third core 6*c*.

The heating assembly 1 is constituted by the holder 2, the coil 5, the first core 6*a*, the holder plugs 19 and the third core 6*c*, the second cores 6*b* and 6*b*, and the magnetic flux shield members 3*a* and 3*b*. The heating assembly 1 thus constituted is securedly fixed and positioned on a supporting side plates 13 and 14 of the main assembly of the apparatus, by locking portions 2*c* and 2*d* of the holder 2 at its opposite end portions.

The heating assembly 1 is out of contact with the inner surface of the fixing roller 7, and in the cross-section of FIG. 3, and is fixed on the fixing roller 7 such that first core 6*a* is disposed at a partly lower portion at an upstream side of the nip N with respect to the rotational direction of the fixing roller 7.

The shaft portion 4*c* of one side of the lead screw member 4 is extended out, and the extended portion 4*c* has a D-shaped cross-section, and is engaged with a gear 11 which is in meshing engagement with a drive gear 20*a* of a driving motor 20.

A control circuit 34 controls the driving motor 20 through a driver 35 so as to rotate the lead screw member 4 in the forward and backward rotational directions through the gears 20*a* and 11, by which the positions of the magnetic flux shield members 3*a* and 3*b* are movable between the first and second positions, as will be described hereinafter.

The coil 5 of the heating assembly 1 and an electric power controlling device 25 are electrically connected through a coil energizing line 15.

(1) First Position of magnetic flux shield members 3*a* and 3*b*

By the backward rotation of the lead screw member 4 (FIG. 4), the two magnetic flux shield members 3*a* and 3*b* are retracted away from the third core 6*c* along the lead screw member 4 in the thrust direction to first positions of the magnetic flux shield members 3*a* and 3*b*, which positions are predetermined distances away from the respective ends of the second core 6*c* outwardly, as shown in FIG. 2.

The control circuit 34 normally maintains the magnetic flux shield members 3*a* and 3*b* at the first movement positions. When a normal size sheet (A4) having a width W1 is passed, that is, the temperature rise does not occur at the non-sheet-passage-part, the magnetic flux shield member 3*a* and 3*b* is not moved from the first position.

When the magnetic flux shield members 3*a* and 3*b* take the first position, the magnetic flux in the magnetic circuit in the normal sheet size width W1 is not blocked by the magnetic flux shield members 3*a* and 3*b*, and therefore, the magnetic circuit therein is as shown in FIG. 5, (a) (Ja).

Figure 7:
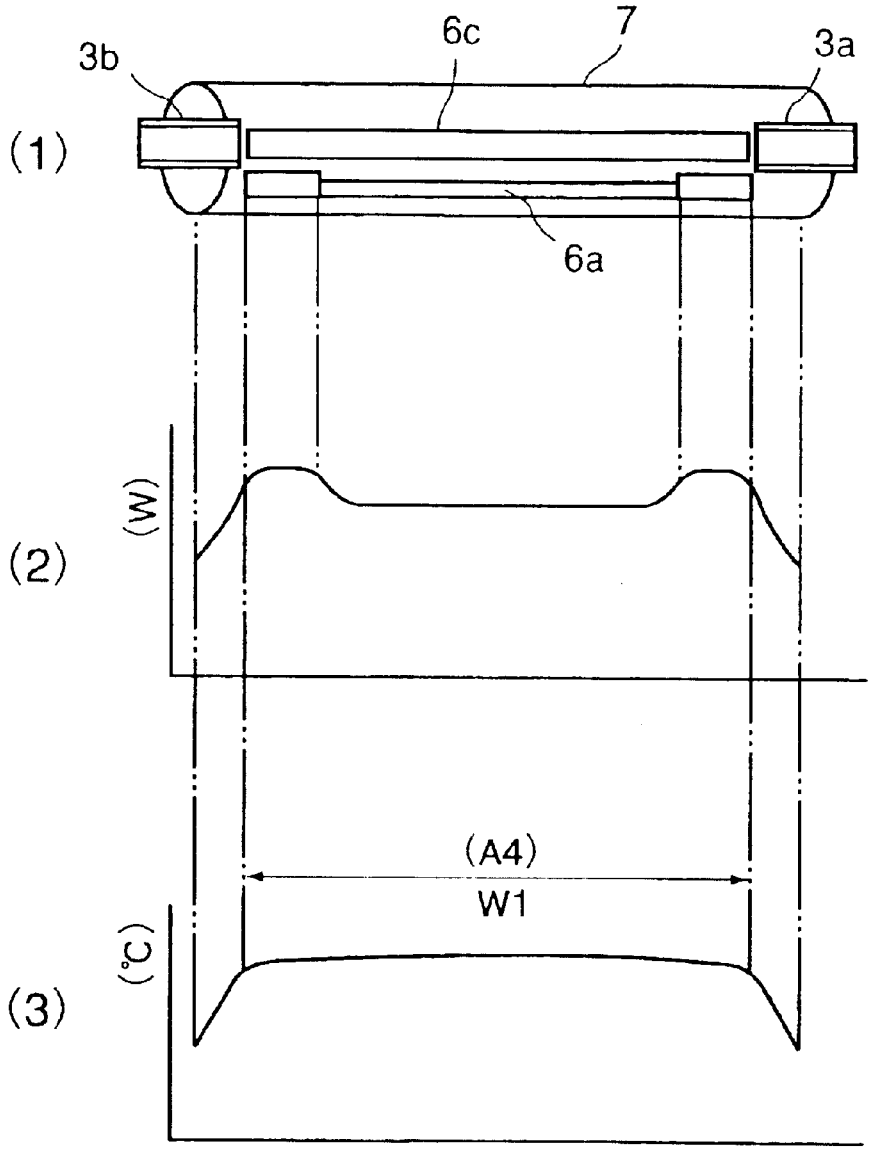
FIG. 7 illustrates a core disposition, a heat generation distribution and a distribution of the surface temperature of the fixing roller when the magnetic flux shield member is at the first position.
Figure 8:
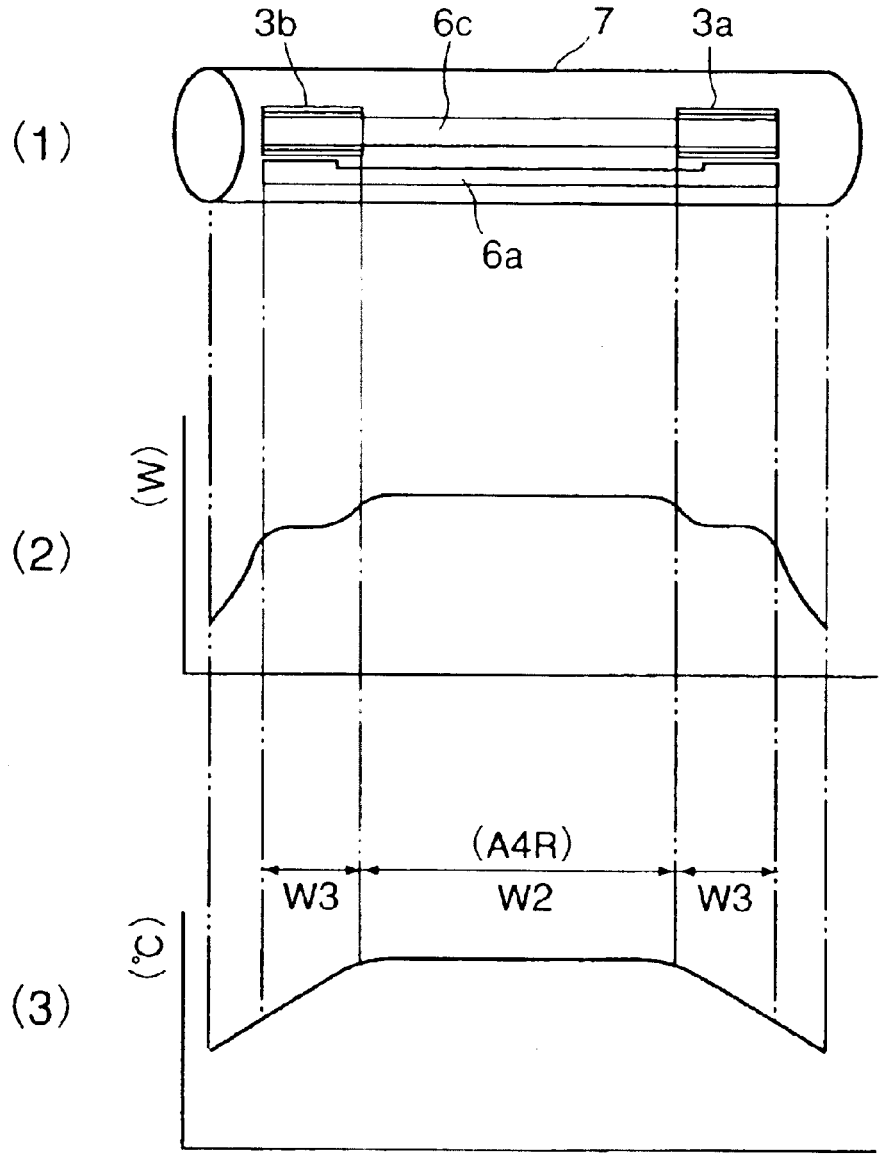
FIG. 8 illustrates a core disposition, a heat generation distribution and a distribution of the surface temperature of the fixing roller when the magnetic flux shield member is at the second position.

The heat generation distribution at the end portion of the normal sheet size width W1 is as shown in FIG. 7, (2) so that heat generation distribution in the longitudinal direction of the fixing roller 7 is such that heat generation is larger at the end portions. The fixing roller surface temperature in this case is as shown in FIG. 7, (3). The heat escape at the end portions are offset, so that temperature is made uniform in the longitudinal direction, and therefore, the proper fixing operation is possible over the entire range of width W1. (1) Second Position of magnetic flux shield members 3*a* and 3*b*.

By the forward rotation of the lead screw member 4, the two magnetic flux shield members 3*a* and 3*b* are advanced toward the second core 6*c* along the lead screw member 4 in the thrust direction to second positions of the magnetic flux shield members 3*a* and 3*b*, that is, to the position corresponding to the non-sheet-passage-parts W3 and W3 at the ends of the third core 6*c*.

When a small size sheet S (A4R) having a width W2 with which the temperature rise occurs in the non-sheet-passage-part, the control circuit 34 operates such that magnetic flux shield members 3*a* and 3*b* are advanced to the second position indicated by chain lines.

In this case, the magnetic flux in the magnetic circuit in the range of the small size sheet width W2 where the magnetic flux shield members 3*a* and 3*b* do not intervene, is not blocked by the magnetic flux shield members 3*a* and 3*b*, and therefore, the magnetic circuit therein is as shown in FIG. 5, (a) (circuit Ja). However, in the non-sheet-passage areas W3 and W3 where the magnetic flux shield members 3*a* and 3*b* intervene, the magnetic circuit is as shown in FIG. 5, (*b*) (circuit Jb) since the portions of the second core 6*c* corresponding to the non-sheet-passage portions W3 and W3 are covered by the shield members 3*a* and 3*b*. That is, the magnetic flux shield members 3*a* and 3*b* block the magnetic flux in the non-sheet-passage area. By this, the fixing operation is possible in the entire region of the small size sheet width W2, but the heat generation of the electromagnetic induction is small in the non-sheet-passage areas W3 and W3, and therefore, the temperature rise in the non-sheet-passage-part is suppressed.

In this manner, the magnetic flux adjusting means moves the magnetic flux shield member 3*a* and 3*b* in the thrust direction, when a recording material S having a small width W2 (A4R) is used (the temperature rise may occur in the non-sheet-passage-part). By doing so, the magnetic flux shielding members 3*a* and 3*b* intervene between the third core 6*c* and the first core 6*a* and between the third core 6*c* and the second core 6*b*. The path for the magnetic flux is changed to control the heat generation of the electromagnetic induction in the longitudinal direction of the fixing roller.

It is known that closer the distance between the coil 5 and the induction heat generating element (fixing roller 7), the better the heat generating efficiency is. In this embodiment, no magnetic flux shield member is provided in the gap between the coil 5 and the fixing roller 7, so that heat generating efficiency can be improved.

The switching between the first and the second positions of the magnetic flux shield members 3*a* and by the forward and backward rotations of the lead screw member 4, is automatically effected by the control circuit 34 depending on the image to be formed, or is determined by the control circuit 34 depending on the sheet size set by the designation of the user. When the size of the used sheet is the one which will result in the temperature rise in the non-sheet-passage-part, the magnetic flux shield members 3*a* and 3*b* are moved to the respective second positions to prevent the temperature rise of the non-sheet-passage-part in the non-sheet-passage-part.

Figure 6:
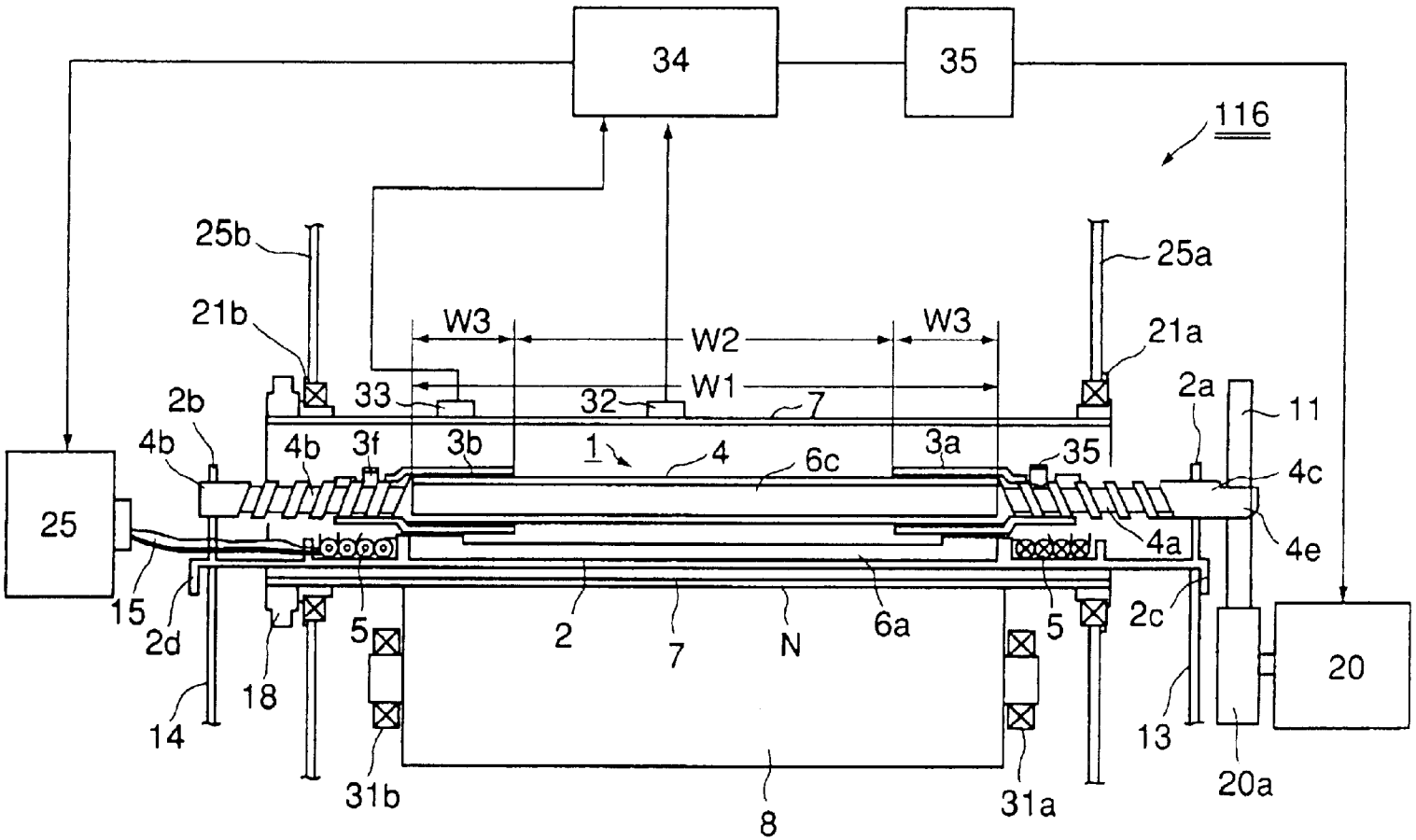
FIG. 6 is a schematic longitudinal sectional view of a fixing device wherein the magnetic flux shield member is at a second position.

In the case that plurality of detecting means for detecting surface temperatures of the fixing roller at a plurality of positions in an image forming apparatus, the magnetic flux shield member 3*a* and 3*b* may be operated in accordance with the outputs of the plurality of detecting means. More particularly, as shown in FIGS. 2 and 6, a first temperature detecting means 32 and a second temperature detecting means 33 are provided, the second temperature detecting means 33 disposed in the position corresponding o the non-sheet-passage-part. In such an example, the magnetic flux shield members 3*a* and 3*b* may be moved to the second position depending on the output of the second temperature detecting means 33. The first temperature detecting means 32 is disposed at a position corresponding to the small size sheet width range.

The present invention does not limit the operation sequence of the magnetic flux shield members 3*a* and 3*b* to a particular one.

When the width of the used sheet is smaller than the normal width W1, and is larger than the smaller size width W2 (so called A4R sheet), that is, when the used sheet is (B4, small size sheet), the magnetic flux shield member 3*a* and 3*b* can be moved to the corresponding positions steplessly. The present invention does not limit the operation sequence of the magnetic flux adjusting means to a particular one.

The magnetic flux shield members 3*a*, 3*b* are made of nonmagnetic material having a high electrical electroconductivity. The use of the non-magnetic member is effective of blocking the magnetic flux. The use to the material having a high electrical electroconductive member the electromagnetic induction heat generation of the magnetic flux shield member per se can be suppressed. In this embodiment, the use is made with the aluminum alloy, but copper, magnesium or silver alloy is usable.

The thickness of the magnetic flux shield members 3*a* and 3*b* is approx. 0.3–1.0 mm. If it is smaller than the lower limit, the magnetic flux shield member per se generates heat by the electromagnetic induction. In addition, the mechanical strength is insufficient. If the thickness is too large, the thermal capacity of the magnetic flux shield member is large with the result that when the fixing roller is to be heated up, the heat is lost by the thickness, and therefore, the waiting time increases.

The material of the lead screw member 4, the holder 2 is preferably PPS resin material, PEEK resin material, mechanical, polyamide resin material, polyamide-imide resin material, ceramic, liquid crystal polymer, fluorine resin material or the like which has a high heat resistive properties and mechanical strength. Furthermore, the material may be added with glass. If the lead screw member and the holder in the magnetic flux generating means is magnetic material, the lead screw member and the holder generate heat by the electromagnetic induction with the result that heat generating efficiency of the fixing roller decreases. When a metal other than the resin material is used, the reduction of the heat generating efficiency may be minimized by using non-magnetic material having a high electroconductivity.

The coil 5 is required to generate alternating magnetic flux sufficient to the heating. It is desirable that resistance component is low, and the inductance component is high. The wire of the coil may be Litz wire comprising a bundle of 80–160 fine wires having a diameter of 0.1–0.3 mm. The fine wires may be insulation coating electric wires. In the coil 5, the wire is wound 8–12 times around the first core 6*a*. Coil 5 is connected with an excitation circuit to supply an alternating current thereto.

The core 6(*a*–*c*) is preferably made of ferrite, permalloy or the like which has a high magnetic permeability and low remanent magnetic flux density, but it may be any if it can generate the magnetic flux.

The present invention is not limited to a particular configuration or configuration of the coil, the core, the induction heat generating element.

In second and fourth embodiment which will be described hereinafter, the third core 6*c* provided on the lead screw member 4 of the fixing device of the first embodiment is modified.

The heat generating efficiency of the magnetic flux generating means can be controlled by changing the configuration of the core. By using the present invention, the latitude in the design of the core configuration and disposition expands so as to be usable with a wide range of the fixing devices.

Embodiment 2

Figure 9:
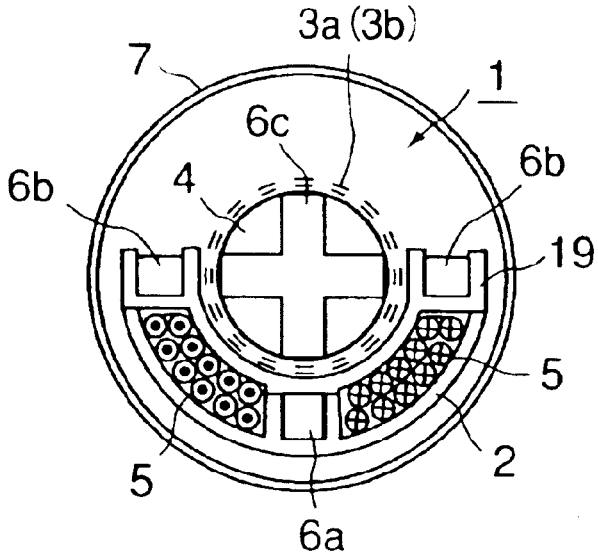
FIG. 9 is a schematic cross-sectional view of a fixing roller according to a second embodiment of the present invention.

As shown in FIG. 9, in th second embodiment, the third core 6*c* has a cross-section of cross. Use of this core permits reduction of the distance between first core 6*a* and the second core 6*b*, so that heat generating efficiency can be enhanced. In the third core 6*c* having the T-shaped cross-section, the same heat generating efficiency can be provided, but the use of the cross type, the influence of the rotation of the lead screw member 4 can be reduced. This is because the same core configuration in the cross-section appears at every 90° rotation of the lead screw member 4.

Embodiment 3

Figure 10:
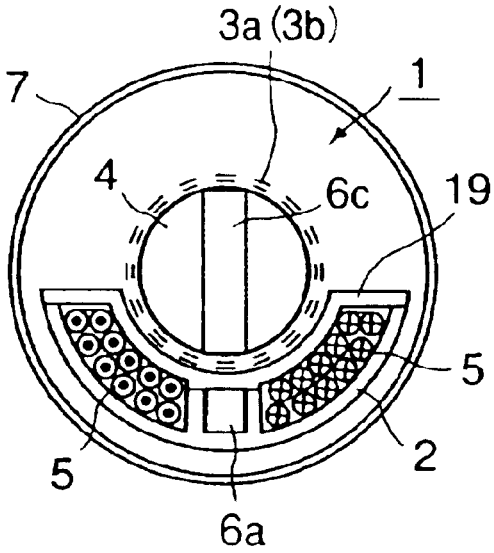
FIG. 10 is a schematic cross-sectional view of a fixing roller according to a third embodiment of the present invention.

As shown in FIG. 10, in the third embodiment, the third core 6*c* has an I-shaped cross-section. No second core 6*b* or 6*b* is used, from the standpoint of the heat generating efficiency, this embodiment is inferior to the foregoing embodiments, but the cost can be reduced by the structural simplification of the core member, the holder 2 and the holder plug 19.

In the second embodiment, by controlling the rotational frequency of the lead screw member 4 changing the pitches of the first and second lead screw portions 4*a* and 4*b*, the same core section as when no temperature rise of the non-sheet-passage-part occurs (during stand-by period) may be provided when the magnetic flux shield members 3*a* and 3*b* are moved.

For example, in the third embodiment, the rotation of the lead screw member 4 is controlled at each 90°, by which the thrust movement distance is limited, but the section core configuration may be made the same as with the stand-by period. In addition, the pitch of the lead screw portions 4*a* and 4*b* may be set corresponding to the frequently used sheet size.

Embodiment 4

Figure 11:
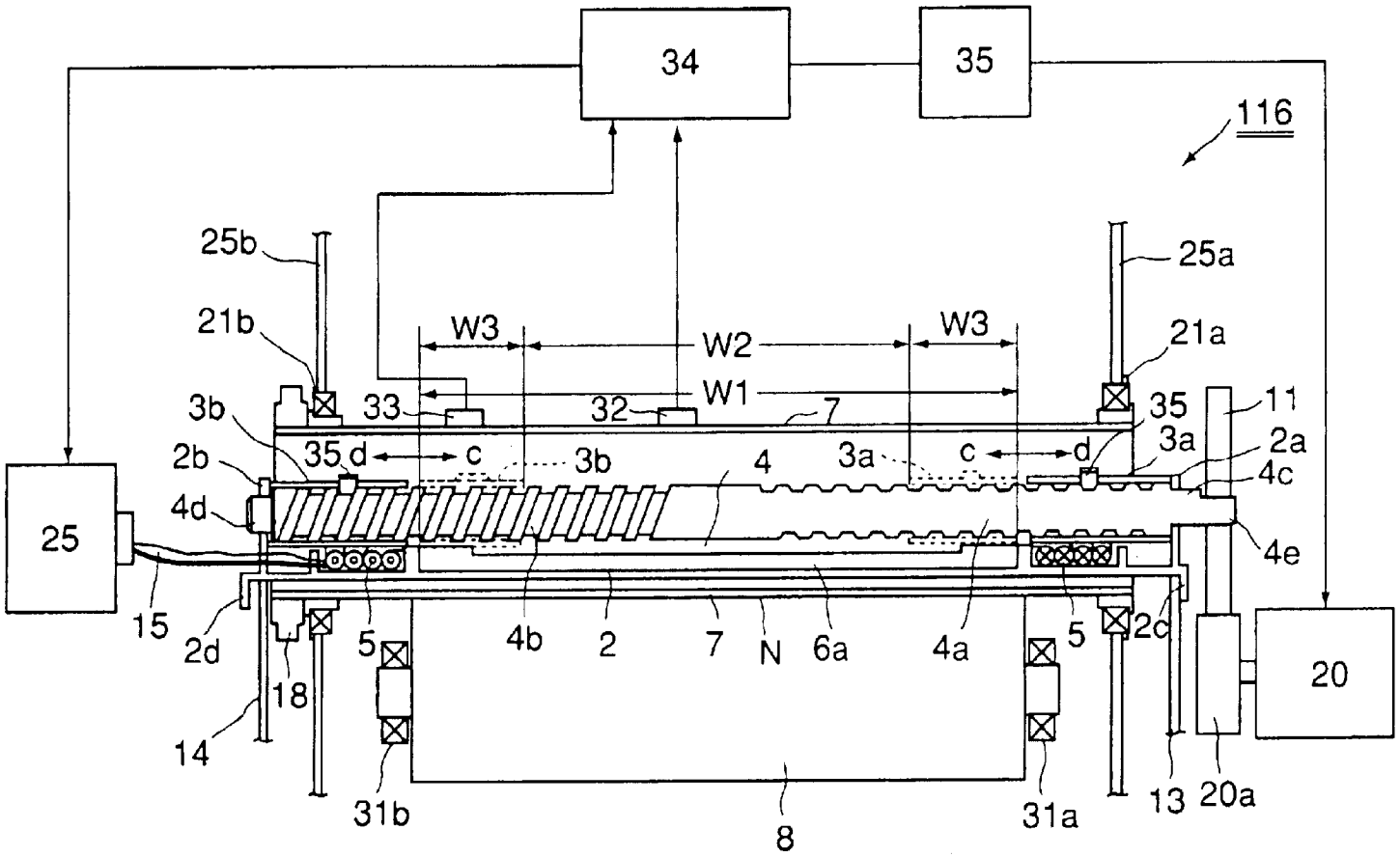
FIG. 11 is a schematic longitudinal sectional view of a fixing device according to a fourth embodiment, wherein the magnetic flux shield member is at the first position).
Figure 12:
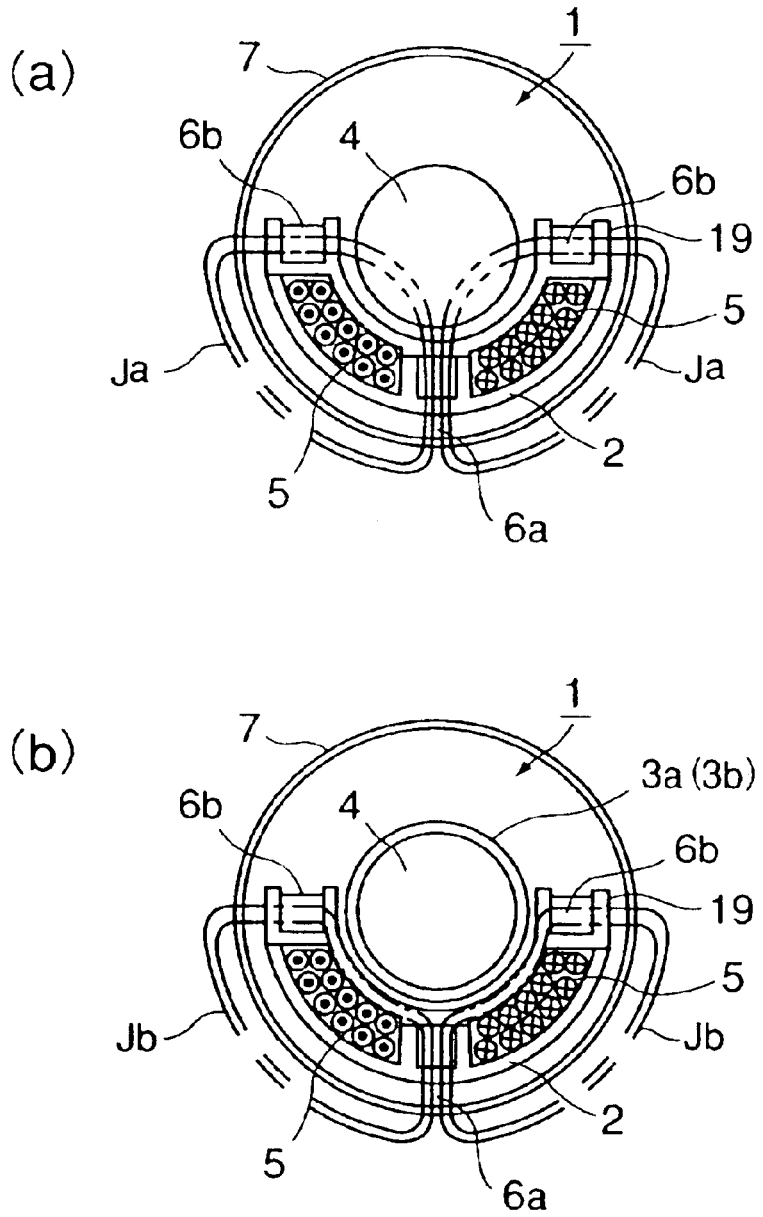
FIG. 12 is a schematic diagram of a magnetic circuit at positions where the magnetic flux shield member is provided and where the magnetic flux shield member is not provided.

As shown in FIG. 11 and FIG. 12, in the fourth embodiment, the third core 6*c* is not provided on the lead screw member 4. Therefore, the magnetic member core 6 of the magnetic flux generating means is constituted by the first core 6*a* and the second core 6*b* and 6*b* as shown in FIG. 12.

(1) When a normal size sheet S (A4) having a width W1 with which the temperature rise in the non-sheet-passage-part does not arise, is used, the magnetic flux shield members 3*a* and 3*b* are kept at the first movement indicated by solid lines in FIG. 11.

When the magnetic flux shield members 3*a* and 3*b* are at the first position, the magnetic flux in the magnetic circuit in the normal sheet size width W1 is not blocked by the magnetic flux shield members 3*a* and 3*b*, and therefore, the magnetic circuit therein is as shown in FIG. 12, (*a*) (Ja). The heat generation distribution at the end portion of the normal sheet size width W1 is as shown in FIG. 7, (2), so that heat generation distribution in the longitudinal direction of the fixing roller 7 is such that heat generation is larger at the end portions. The fixing roller surface temperature in this case is as shown in FIG. 7, (3). The temperature is made uniform in the longitudinal direction, and therefore, the proper fixing operation is possible over the entire range of width W1.

(2) When a small size sheet S (A4R) having a width W2 with which the temperature rise occurs in the non-sheet-passage-part, the magnetic flux shield members 3*a* and 3*b* are advanced to the second position indicated by chain lines.

In this case, the magnetic flux in the magnetic circuit in the range of the small size sheet width W2 where the magnetic flux shield members 3*a* and 3*b* do not intervene, is not blocked by the magnetic flux shield members 3*a* and 3*b*, and therefore, the magnetic circuit therein is as shown in FIG. 12, (*a*) (circuit Ja).

However, in the non-sheet-passage areas W3 and W3 where the magnetic flux shield members 3*a* and 3*b* intervene, the magnetic circuit is as shown in FIG. 12, (*b*) (circuit Jb) since the portions of the second core 6*c* corresponding to the non-sheet-passage portions W3 and W3 are covered by the shield members 3*a* and 3*b*. That is, the magnetic flux shield members 3*a* and 3*b* block the magnetic flux in the non-sheet-passage area. By this, the fixing operation is possible in the entire region of the small size sheet width W2, but the heat generation of the electromagnetic induction is small in the non-sheet-passage areas W3 and W3, and therefore, the temperature rise in the non-sheet-passage-part is suppressed.

Thus, in this embodiment, similarly to the foregoing embodiments, by moving the magnetic flux shield members 3*a* and 3*b* in the thrust direction, the flow of the magnetic flux between the first core 6*a* and the second core 6*b* is impeded, so that heat generating efficiency is changed, thus changing the distribution of the temperature of the surface of the fixing roller in the longitudinal direction can be changed.

According to this embodiment, as shown in FIG. 11, the screw portions 4*a*, 4*b* of the lead screw member 4 can be extended to the central portion of the fixing roller, and, therefore, the sheet size corresponding width can be increased.

In addition, the use be made with a magnetic flux generating means having no core (coreless coil), wherein the magnetic flux shield members 3*a* and 3*b* are moved into the coil 5, by which the heat generating efficiency can be made different along the longitudinal direction similarly to the foregoing embodiments.

By changing the flow of the magnetic flux inside the coil 5 is made different along the longitudinal direction, by which the distribution, in the longitudinal direction of the fixing roller, of the heat generation can be changed.

Embodiment 5

Figure 13:
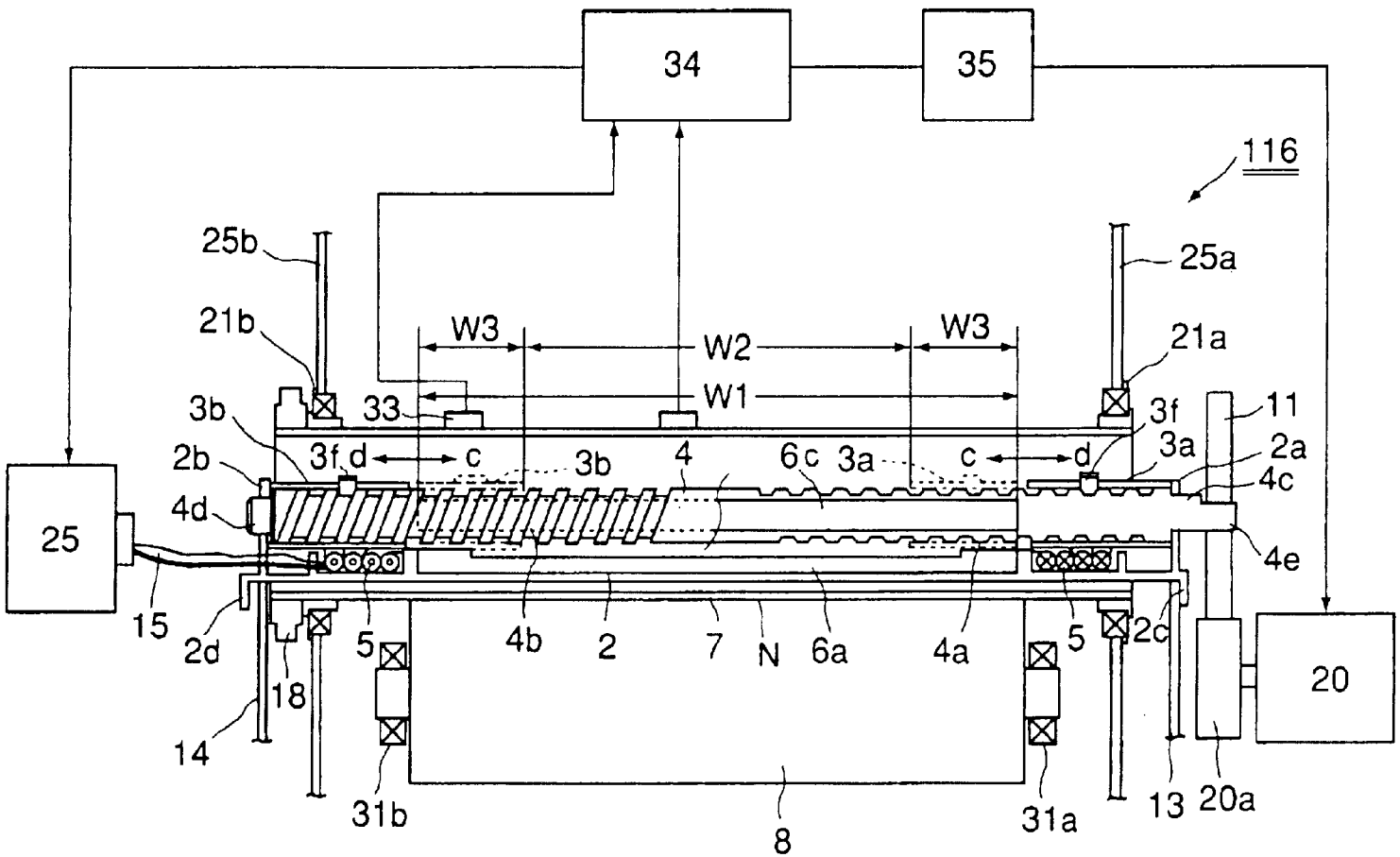
FIG. 13 is a longitudinal sectional view of a fixing device according to a fifth embodiment of the present invention wherein the magnetic flux shield member is at a first position.
Figure 14:
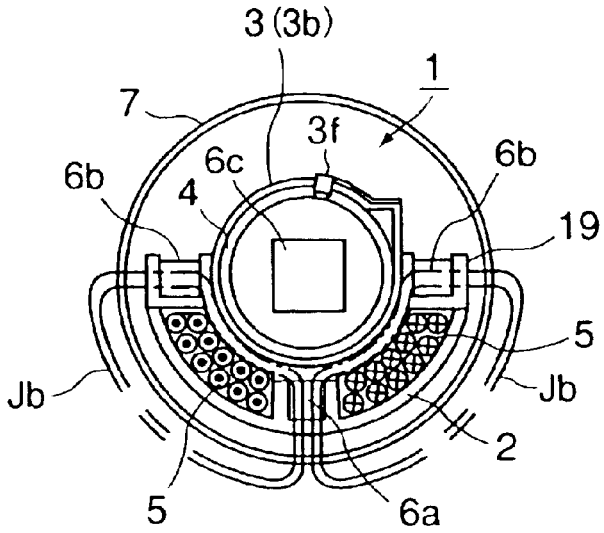
FIG. 14 is a schematic diagram of a magnetic circuit where the magnetic flux shield member is provided.

As shown in FIG. 13 and FIG. 14, the diameter of the lead screw member 4 is made larger, and the second core 6*c* is provided in the lead screw member 4.

By doing so, it is necessary to use a magnetic flux shield members 3*a* and 3*b* exclusively for blocking the magnetic flux as with the first embodiment. As shown in FIG. 13 and FIG. 14, the magnetic flux shield member 3 is provided only at the portion engaging with the screw portions 4*a* and 4*b* of the lead screw member 4 is sufficient. By this, the space saving is accomplished in the longitudinal direction.

Similarly to the fourth embodiment, in this embodiment, as shown in FIG. 14, the screw portions 4*a* and 4*b* of the lead screws member 4 can be formed to the central portion of the fixing roller, so that width corresponding to the sheet size can be increased.

In the foregoing, five embodiments are described. They may be used in consideration of the specifications, arrangement of the fixing device of the image forming apparatus with which the heating device is used.

The advantageous effects of the present invention are maintained when a fixing film is used in place of the fixing roller.

The advantageous effects of the fixing device of the foregoing embodiments are summarized as follows.

By the provision of the magnetic flux shield members 3*a* and 3*b* effective to block or shield the magnetic flux at a position opposite the side facing the fixing roller 7 (induction heat generating element), the gap between the coil 5 and the fixing roller 7 can be reduced, so that heat generating efficiency is improved, and the energy saving can be accomplished.

By the provision at the opposite side, the space saving is accomplished.

The space occupied by the magnetic flux shield member upon non-operation thereof outside the fixing roller or film can be reduced, so that space saving is accomplished, and therefore, the main assembly of the image forming apparatus can be downsized.

With a conventional structure in which the magnetic flux shield member is rotated, the magnetic flux shield member and the coil are contacted with the possible result of damage of the coil. According to the structure of the present invention, the contact of the coil and the magnetic flux shield member can be avoided.

In a conventional structure in which the sheet is fed through the fixing device along the center thereof (center portion reference feeding system), the spaces are required at both of the opposite longitudinal end portions of the fixing device, for the magnetic flux shield member placed at the non-operative (retracted) position and for the driving means for the magnetic flux shield member. According to the present invention, the magnetic flux shield member is kept in the fixing roller, and the driving means can be disposed at one end longitudinal end portion only, so that space saving is accomplished, and the main assembly of the image forming apparatus can be downsized.

According to the present invention, the problem of the temperature rise in the non-sheet-passage-part can be solved without slowing down the fixing speed, and therefore, the printing or copying throughput can be improved.

The magnetic flux generating means (coil and core), the holder, the magnetic flux shield member are constituted into one assembly, so that assembling property and the servicing property can be improved.

Others 1) the moving means for moving the magnetic flux shield members 3*a* and 3*b* in the thrust direction may be another proper means in place of the lead screw member 4 or the like. For example, a known cylindrical cam mechanism used in the field of zoom camera is usable.

2) the sheet may be fed with one lateral side aligned with one longitudinal end of the heating device, in which case the heating apparatus is properly constructed corresponding to the system.

3) the applicability of the heating apparatus of the electromagnetic induction heating type and magnetic flux adjustment type is not limited to the image heat-fixing device, but is possible with respect to an image heating device by which the image carrying recording material is heated to improve the surface property such as glossiness or the like, an image heating device for temporary fixing processing, a drying process by which the sheet-like material is dried by passing it through the heating device, a heating device for laminating a sheet-like material, a dry fixing device usable with an ink jet printer or the like, for example.

As described in the foregoing, according to the present invention, there is provided a heating apparatus of an electromagnetic induction heating type having a magnetic flux shield means for preventing a temperature rise in the non-sheet-passage-part, wherein the space required by the retracted magnetic flux shield member and the space required by the driving means therefor can be reduced so that magnetic flux shield mechanism is downsized, and the cost thereof is reduced, the electric power saving is accomplished, and the throughput is improved.

While the invention has been described with reference to the structures disclosed herein, it is not confined to the details set forth and this application is intended to cover such modifications or changes as may come within the purpose of the improvements or the scope of the following claims.

What is claimed is:

1. A heating apparatus comprising:

a coil for generating a magnetic flux;

a heat generating element having a heat generating portion for induction heat generation by the magnetic flux generated by said coil;

a magnetic core, disposed at a side across said coil from said heat generating portion, for enchancing the magnetic flux acting on said heat generating element;

magnetic flux adjusting means for adjusting a density distribution of the magnetic flux acting on said heat generating element with respect to a widthwise direction of a material to be heated which is a direction perpendicular to a feeding direction of the material to be heated; and moving means for moving said magnetic flux adjusting means, wherein said moving means is effective to move said magnetic flux adjusting means inbetween said core and said coil.

2. An apparatus according to claim 1, wherein said magnetic flux adjusting means includes a magnetic flux shield member, and wherein said moving means is effective to move said magnetic flux shield member in the widthwise direction and is also effective to guide said magnetic flux shield member and to transmit a driving force to said magnetic flux shield member, wherein said moving means extends in the widthwise direction.

3. An apparatus according to claim 2, further comprising a magnetic member core cooperative with said guiding member.

4. An apparatus according to claim 1, wherein said magnetic flux adjusting means is made of a non-magnetic material having a high electrical electroconductivity.

5. An apparatus according to claim 1, wherein said magnetic flux adjusting means is made of aluminum, copper, magnesium, or silver alloy.

6. An apparatus according to claim 1, wherein when a material to be heated has a width smaller than a maximum feedable width, said moving means moves said magnetic flux adjusting means inbetween said core and said coil, by which a temperature of a non-feeding width region is lowered.

7. A heating apparatus comprising:

a coil for generating a magnetic flux;

a heat generating element having a heat generating portion for induction heat generation by the magnetic flux generated by said coil;

a first magnetic core for forming a path of the magnetic flux generated by said coil;

a second magnetic core cooperative with said first magnetic core to form the path for the magnetic flux generated by said coil;

magnetic flux adjusting means for adjusting a density distribution of the magnetic flux acting on said heat generating element with respect to a widthwise direction of a material to be heated which is a direction prependicular to a feeding direction of the material to be heated; and moving means for moving said magnetic flux adjusting means, wherein said moving means moves said magnetic flux adjusting means inbetween said first magnetic core and said second magnetic core.

8. A heating apparatus comprising:

a coil for generating a magnetic flux;

a heat generating element having a heat generating portion for induction heat generation by the magnetic flux generated by said coil, magnetic flux adjusting means for adjusting a density distribution of the magnetic flux acting on said heat generating element with respect to a widthwise direction of a material to be heated which is a direction prependicular to a feeding direction of the material to be heated; and moving means for moving said magnetic flux adjusting means, wherein said moving means lowers a temperature of said heat generating element opposing to said magnetic flux adjusting means by moving said magnetic flux adjusting means to a side opposite from said heat generating portion with respect to said coil within a path of the magnetic flux generated by coil.

9. An apparatus according to claim 6 or 8, wherein said magnetic flux shield member is made of a material having non-magnetic property and high electroconductivity.

10. An apparatus according to claim 7, wherein when a material to be heated has a width smaller than a maximum feedable width, said moving means moves said magnetic flux adjusting means inbetween said first magnetic core and said second magnetic core, by which a temperature of a non-feeding width region is lowered.

11. An apparatus according to claim 8, wherein when a material to be heated has a width smaller than a maximum feedable width, said moving means moves said magnetic flux adjusting means, by which a temperature of a non-feeding width region is lowered.

12. A heatin apparatus comprising:

a coil for generating a magnetic flux;

a heat generating element having a heat generating portion for induction heat generation by the magnetic flux generated by said coil;

a magnetic core disposed across a magnetic flux generated by said coil without entering a gap between said coil and said heat generating portion;

magnetic flux adjusting means for adjusting a density distribution of the magnetic flux acting on said heat generating element with respect to a widthwise direction of a material to be heated, which is a direction perpendicular to a feeding direction of the material to be heated; and moving means for moving said magnetic flux adjusting means, wherein said moving means is effective to move said magnetic flux adjusting means inbetween said core and said coil.

13. An apparatus according to claim 7, wherein said first magnetic core and said second magnetic core are disposed without entering a gap between said heat generating portion and said coil.

* * * * *

UNITED STATES PATENT AND TRADEMARK OFFICE

CERTIFICATE OF CORRECTION

PATENT NO. : 6,963,718 B2
APPLICATION NO. : 10/270142
DATED : November 8, 2005
INVENTOR(S) : Hajime Sekiguchi It is certified that error appears in the above-identified patent and that said Letters Patent is hereby corrected as shown below:

Column 1
Line 15, "Is" should read -- is --.
Line 32, "((fixing" should read -- (fixing --.
Line 41, "or" should read -- of --.

Column 2,
Line 30, "Hei 9-171589" should read -- Hei 9-171889 --.
Line 49, "result" should read -- resulted --.
Line 67, "A" should be deleted.

Column 3,
Lines 29 and 38, "in addition" should read -- is --.
Line 64, "position)." should read -- position. --.

Column 4,
Line 11, "or" should read -- of --.
Line 15, "machines" should read -- machine --.
Line 22, "or" should read -- of --.
Line 24, "photo-electrically" should read -- photoelectrically --.
Line 26, "RDR)" should read -- RDF) --.

Column 5,
Line 57, "the direction" should read -- the --.
Line 58, "arrow An" should read -- arrow A --.

Column 6,
Line 11, "he" should read -- the --.
Lines 28 and 38, "or" should read -- of --.
Line 59, delete "has coil 5".

Column 7,
Line 5, "ant" should read -- and --.
Line 11, "us" should read -- is --.
Line 16, "2*a*2*b* should read -- 2*a*, 2*b* --.
Line 34, "core 6 an" should read -- cores 6a --.
Line 42, "two the" should read -- two --.

UNITED STATES PATENT AND TRADEMARK OFFICE

CERTIFICATE OF CORRECTION

PATENT NO. : 6,963,718 B2
APPLICATION NO. : 10/270142
DATED : November 8, 2005
INVENTOR(S) : Hajime Sekiguchi It is certified that error appears in the above-identified patent and that said Letters Patent is hereby corrected as shown below:

Column 8,
Line 27, "securedly" should read -- securely --.

Column 9,
Line 55, "that" should read -- that the --.

Column 10,
Line 14, "o" should read -- to --.
Line 54, "has a" should read -- has --.

Column 11,
Line 2, "coating" should read -- coated --.
Line 12, "In" should read -- In the --.
Line 23, "th" should read -- the --.

Column 12,
Line 61, "use a" should read -- use --.

Column 13,
Line 44, "one end" should read -- one --.

Column 16,
Line 1, "Claim 6 or 8," should read -- claim 7 or 8, --.
Line 16, "heatin" should read -- heating --.

Signed and Sealed this

Eleventh Day of July, 2006

JON W. DUDAS
*Director of the United States Patent and Trademark Office*